US006464204B1

(12) United States Patent
Johnson et al.

(10) Patent No.: US 6,464,204 B1
(45) Date of Patent: Oct. 15, 2002

(54) PORTABLE VEHICLE LIFT AND METHOD

(75) Inventors: Danny L. Johnson, Tulsa, OK (US); Dave Lewis, Broken Arrow, OK (US)

(73) Assignee: Kwiklift, Inc., Broken Arrow, OK (US)

( * ) Notice: Subject to any disclaimer, the term of this patent is extended or adjusted under 35 U.S.C. 154(b) by 0 days.

(21) Appl. No.: 09/795,247

(22) Filed: Feb. 26, 2001

Related U.S. Application Data

(60) Division of application No. 09/390,078, filed on Sep. 3, 1999, now Pat. No. 6,206,346, which is a continuation-in-part of application No. 09/062,862, filed on Apr. 20, 1998, now Pat. No. 5,947,448.

(51) Int. Cl.[7] ..... E02C 3/00

(52) U.S. Cl. ..... 254/88; 254/91; 254/89 R

(58) Field of Search ..... 254/1, 3 R, 3 B, 254/3 C, 5 R, 5 B, 5 C, 88, DIG. 9, 93 R, 93 H, 7, 90, 91; 187/216

(56) References Cited

U.S. PATENT DOCUMENTS 5,641,150 A * 6/1997 Rober ..... 254/88

* cited by examiner

*Primary Examiner*—Joseph J. Hail, III
*Assistant Examiner*—Daniel Shanley
(74) *Attorney, Agent, or Firm*—Bable & Gotwals

(57) ABSTRACT

A portable vehicle lifting apparatus and method comprising a plurality of ramps having a lifting bar means pivotally connected between each ramp. The apparatus, via the lifting bar meas, raises and lowers a vehicle which has been loaded onto the ramps.

19 Claims, 8 Drawing Sheets

PORTABLE VEHICLE LIFT AND METHOD

REFERENCE TO PENDING APPLICATIONS

This application is a division of corresponding application Ser. No. 09/390,078, filed Sep. 3, 1999, now U.S. Pat. No. 6,206,346 which is a continuation-in-part of application Ser. No. 09/062,862, filed Apr. 20, 1998 (now U.S. Pat. No. 5,947,448).

REFERENCE TO MICROFICHE APPENDIX

This application is not referenced in any microfiche appendix.

BACKGROUND OF THE INVENTION

1. Field of the Invention

The present invention relates generally to a vehicle lifting apparatus and method, specifically, toward a vehicle lifting apparatus and method having a plurality of ramps upon which a vehicle can be placed and which are raised and lowered by a lifting means.

2. Prior Art

Vehicle lifting apparatus are exemplified in the disclosures of Munday, U.S. Pat. No. 1,527,901 of Feb. 1, 1924; Hunter U.S. Pat. No. 4,238,003 of Dec. 9, 1980; Fawdry U.S. Pat. No. 4,486,006 of Dec. 4, 1984 and Rober U.S. Pat. No. 5,641,150 of Jun. 24, 1997. Each of these prior art patents embody a vehicle lift apparatus in which a pair of pivotal ramps move between a generally horizontal position and an angled position. The pivoting mechanism is either a fulcrum type mechanism located approximately at the center of each ramp or a pivotal mechanism connected to a base at one end of each ramp. The lifting mechanisms of each apparatus have taken on different forms including pistons, pressurized fluids lifting devices and cylinder lifting devices.

The prior art discloses a number of problems and difficulties, the first of which is the complicated nature of the devices. Due to the intricate nature of these devices, great care is needed when during the installation and use of these devices. Another problem in the art is the lack of portability of the apparatus. The prior art patents disclose apparatus which are required to be secured to a floor or include bulky or heavy machinery.

The present invention is directed toward a vehicle lift apparatus and method which address the problems in the prior art.

SUMMARY OF THE INVENTION

The present invention is directed toward a vehicle lift apparatus and method which includes a plurality of ramps which are able to be moveable between a generally raised position and a generally lowered position. While in the lowered position, a vehicle can be loaded onto or off of the ramp set. The ramps are moved into the generally raised position by the use of a lifting bar means such as a floor jack, forklift jack or other suitable lifting means. The ramps are supported by support legs which pivot from each ramp.

Each ramp has a first end and a second end. Each first end can be pivotally connected to a base portion or can be free standing. When a base portion is utilized, the ramp is able to be pivotally movable between a generally horizontal position and a generally angled position. When the first end is free standing, it can provide access for vehicles to be loaded onto and off of each ramp. Each second end is free standing and can provide an access for vehicles to be loaded onto and off of each ramp.

Each ramp is further described as being either a single piece of material or comprises a plurality of interlocking parts. These variations are to accommodate the various sizes and weights of the known vehicles. For example, due to the weight of a forklift, a ramp made of a single piece of material would be better suited for lifting the forklift, as compared to a lightweight automobile which could be easily raised using a multi-component ramp set.

Transition ends can be connected to the ends of each ramp. These transition ends are tapered downward from the ramp to the ground and provide for a smooth transition from the ground to the ramp.

The lifting bar means is pivotally connected to both ramps. When a base portion is utilized, the lifting bar means is connected proximate to the second ends of the ramps. When a base portion is not utilized, lifting bar means is connected proximate to both ends of the ramps.

The lifting bar means has two general configurations, a intermediate offset configuration and a lifting rod configuration. The lifting bar means utilizing the intermediate offset configuration is pivotally connected to both ramps in a generally perpendicular manner and is movable between a generally horizontal position and a generally vertical position. When the lifting bar is in a generally vertical position, the offset portion creates a recess between the bar and the ground. A lifting means, such as but not limited to a floor jack, can be placed within the recess and when activated lift the ramps via the lifting bar to a desired height. When the lifting bar is in a generally horizontal position, the offset portion is in contact with the ground, allowing vehicles to be loaded onto or off of the ramps without contact to the bar.

The lifting bar means utilizes the a lifting rod configuration has a lifting rod secured to it. This provides a means for a lifting means to move the lifting bar. The lifting means, such as but not limited to a forklift jack, can be placed in communication with the lifting rod and when activated lift the ramps via the lifting bar to a desired height.

The lifting bar provides additional benefits over the prior art. The lifting bar provided latitudinal support to the pair of ramps. By being connected to both ramps, the lifting bar prevents the ramps from moving independently of each other in a latitudinal manner. Further, the distance between the pair of ramps can be adjusted to accommodate the width of any vehicle. This is accomplished by adjusting the length of the lifting bar or by having multiple width connections on the lifting bar.

Additionally, the apparatus improves over the prior art in that it can be easily disassembled, allowing for easy transportability and storage. The apparatus can be broken down into three main parts, the base, the ramps, and the lifting bar.

Further, by having the lifting bar located near the rear portion of the ramps, there is no lifting machinery located directly underneath the vehicle. This will allow a person, such as a mechanic, to have complete access to the undercarriage of the vehicle. This is an advantage over prior art lifting devices.

The primary objective of the present invention is to provide an apparatus embodying simple effective means for lifting a vehicle.

Another objective of the present invention is to provide an apparatus which does not require the use of complicated machinery.

Another objective of the present invention is to provide an apparatus which can be easily portable and storable.

DETAILED DESCRIPTION OF THE PREFERRED EMBODIMENTS

Referring now to the figures, a vehicle lifting apparatus 10 according to the present invention is shown. The vehicle lifting apparatus 10 generally comprises of a plurality of ramps 14 and a lifting bar means 32 pivotally connected to said ramps 14.

Figure 1:
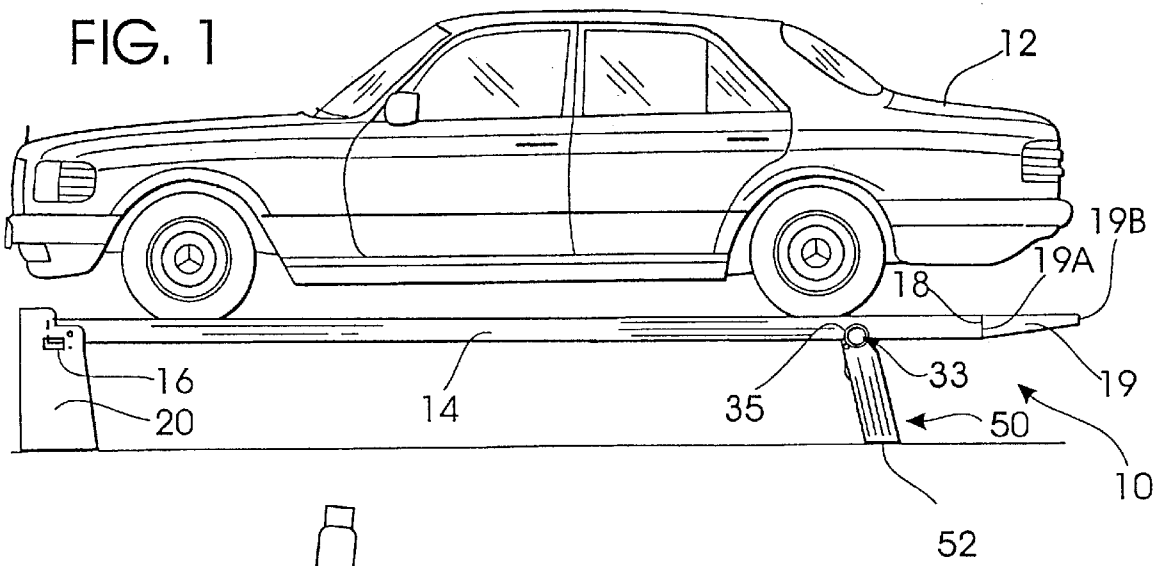
FIG. 1 is a perspective view of the present invention in the generally horizontal position.
Figure 1A:
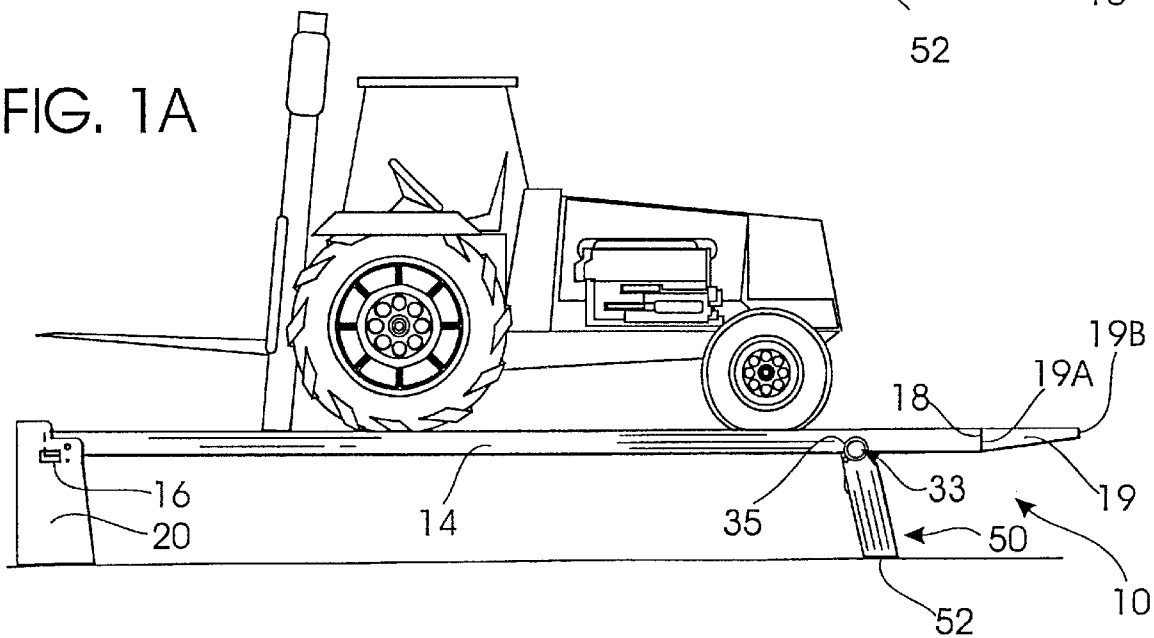
FIG. 1A is a perspective view of the present invention in the generally horizontal position.
Figures 2, 3, 4:
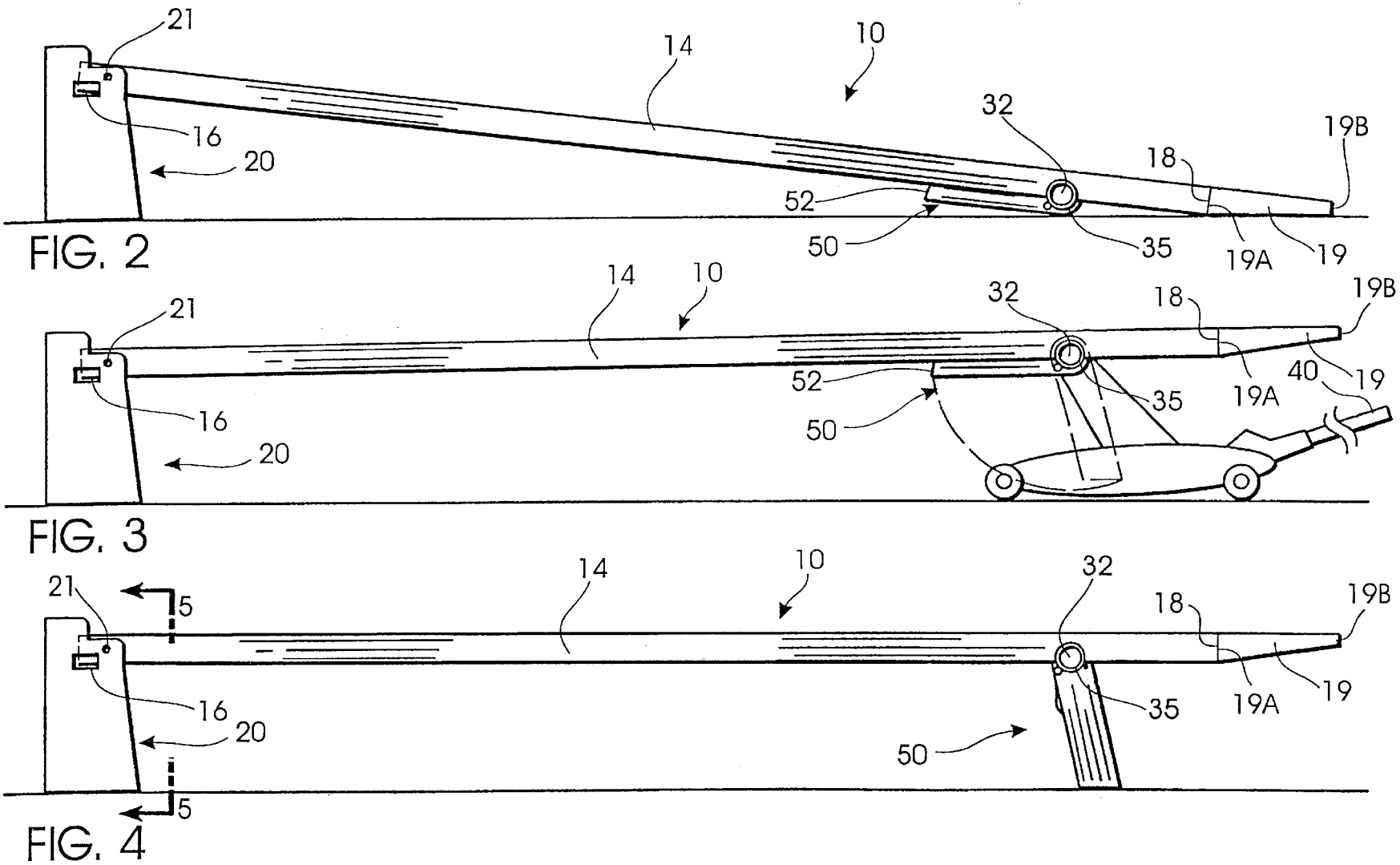
FIG. 2 is a perspective view of the present invention in a generally angled position.
FIG. 3 is a view similar to FIG. 2 showing the present invention being lifted by the means of a lifting device.
FIG. 4 is a view similar to FIG. 2 showing the present invention in a generally horizontal position.

As shown in FIGS. 1–4, ramp 14 is pivotally mounted to base 20 and is able to move between an angled position as shown in FIG. 2 to a generally horizontal position as shown in FIG. 4. Ramp 14 is able to be raised or lowered into the desired position by means of a floor jack 40 being engaged with lifting bar 32.

Ramp 14 comprises a first end 16 and a rear end 18. To provide for a more smooth transition from the ground onto ramp 14, transition ramp end 19 can be attached to rear 18. Transition ramp end 19, having a first end 19A and a second end 19B, is tapered in a downward fashion from first end 19A to second end 19B. While the description of the preferred embodiment describes ramp 14 as a single continuous piece of material, it is understood that ramp 14 can consist of a plurality of interlocking parts which can be easily disassembled for portability and storage.

Figure 5:
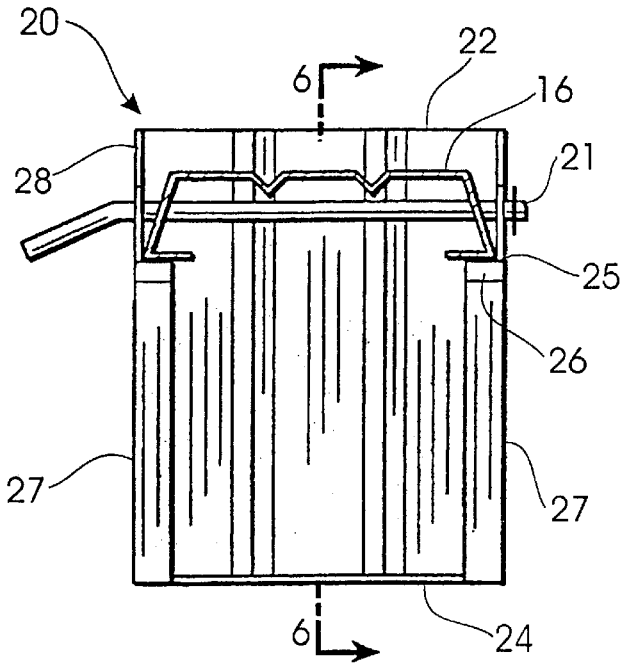
FIG. 5 is a cross-sectional view of FIG. 4 along line 5—5.
Figure 6:
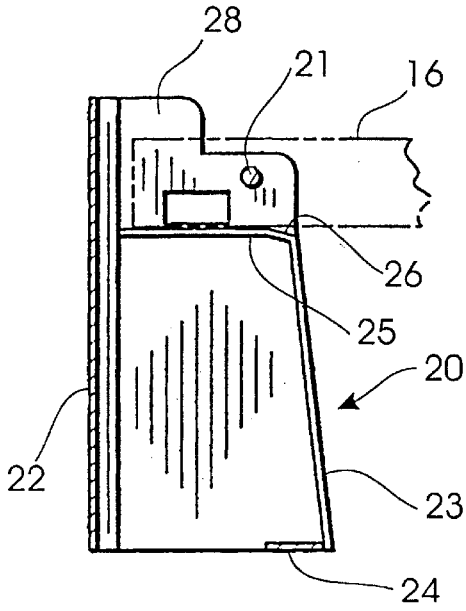
FIG. 6 is a cross-sectional view of FIG. 5 along line 6—6.
Figure 7:
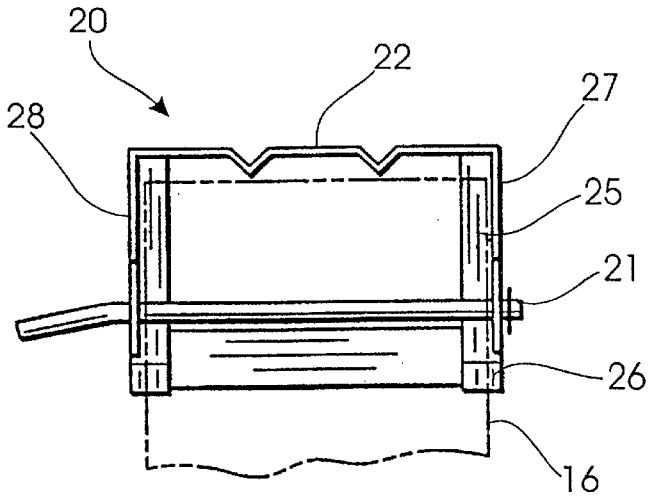
FIG. 7 is a cross-sectional top view of FIG. 5.

Base unit 20 is generally shown in FIGS. 5–7. Base unit 20 comprises a front panel 22, a back panel 23, a bottom panel 24, two side panels 27, retaining wall 28, support ledge 25, having as an angled ledge section 26 proximate to back panel 23. Ramp 14 rests upon support ledge 25 and is secured to base 20 by means of pin 21. Angled ledge 26 allows ramp 14 to pivot into an angled position while remaining secured to said base unit 20.

Figure 8:
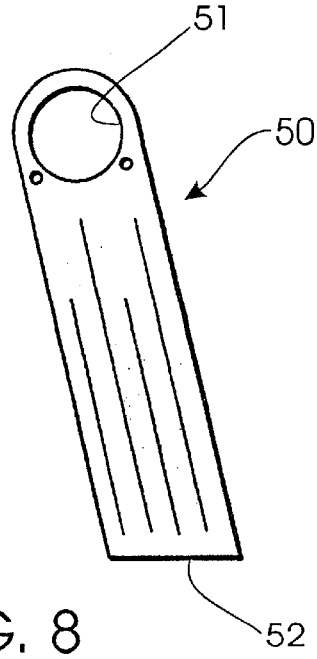
FIG. 8 is a view of the pivoting rear leg.

As shown in FIG. 8, support leg 50 comprises pivot end 51 and a securing end 52. Pivot end 51 is pivotally mounted to tube 35 and is secured by securing means 38. Support leg 50 is in a generally retracted state located within ramp 14 when ramp 14 is in a generally angled position. When ramp 14 is raised to a generally horizontal position, support leg 50 pivots into a generally vertical position with support end 52 being in contact with the ground.

Figure 9:
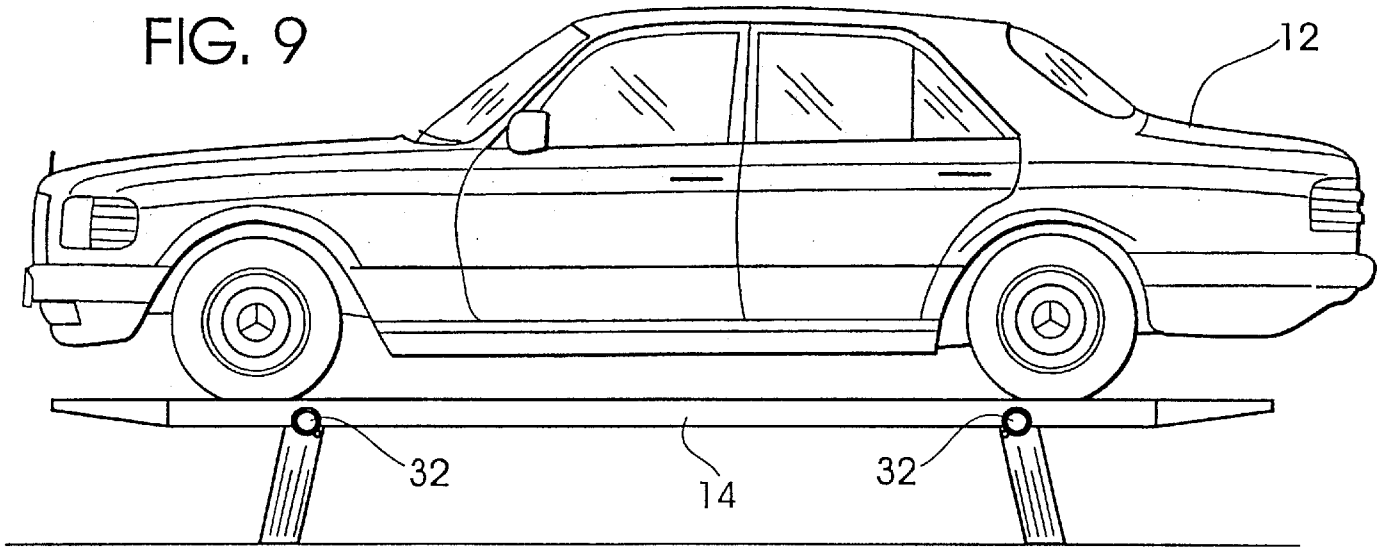
FIG. 9 is a perspective view of the present invention showing a two lift bar configuration.
Figure 9A:
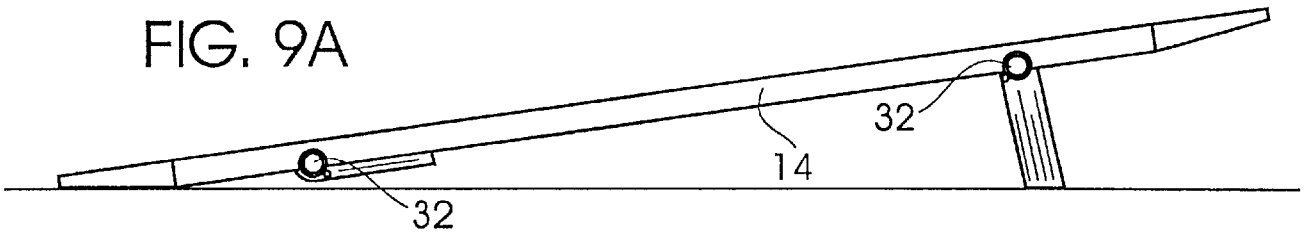
FIG. 9A is a view similar to FIG. 9 showing the present invention in a generally angled position.
Figure 9B:
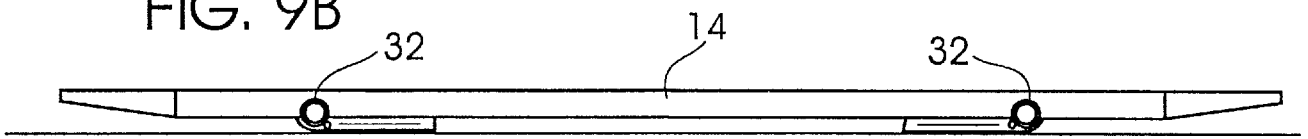
FIG. 9B is a view similar to FIG. 9 showing the present invention in a generally lowered position.

As shown in FIG. 9–9B, an alternative embodiment of the vehicle lifting apparatus 10 is shown. In this embodiment, ramps 14 are pivotally connected to a plurality of lifting bars 32 and are able to be moved between a generally lowered position to a generally raised position. Ramps 14 are able to be raised or lowered into the desired position by a lifting means such as a floor jack or fork lift jack. By not utilizing base units 20 in this embodiment, a vehicle is able to be driven onto said ramps and off of said ramps without the necessity to reverse the direction of the vehicle.

Figure 11:
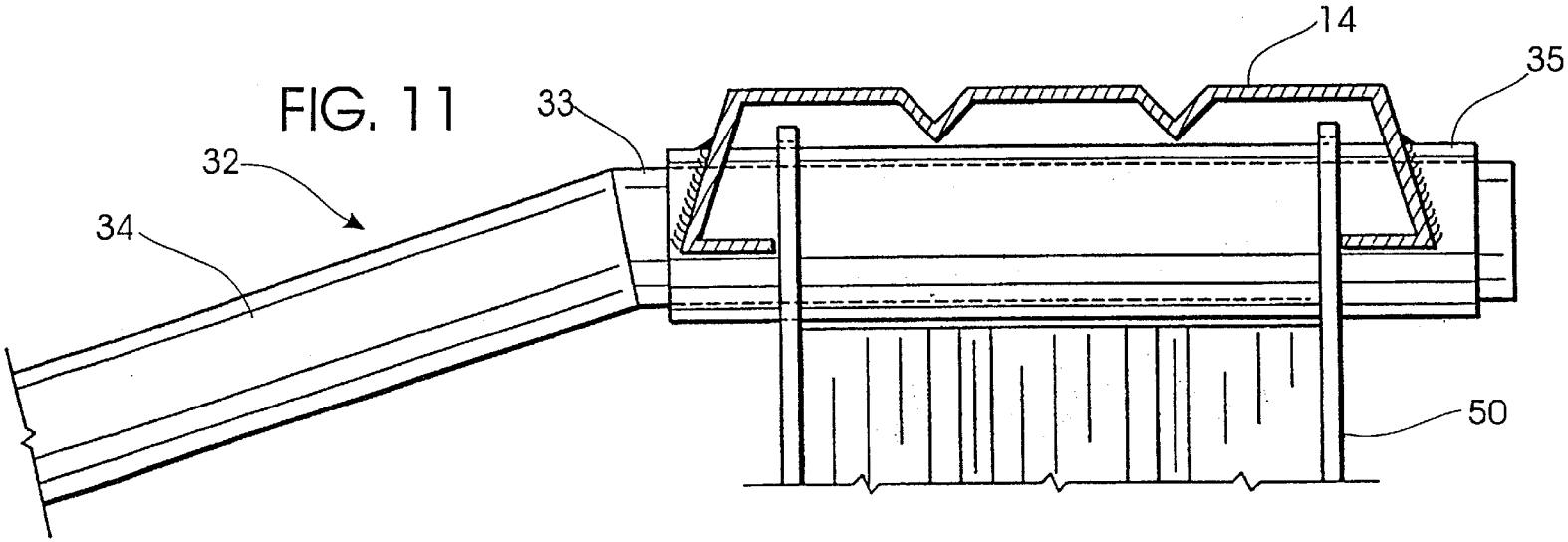
FIG. 11 is a detailed rear view of the rear housing assembly of FIG. 10.
Figure 10:
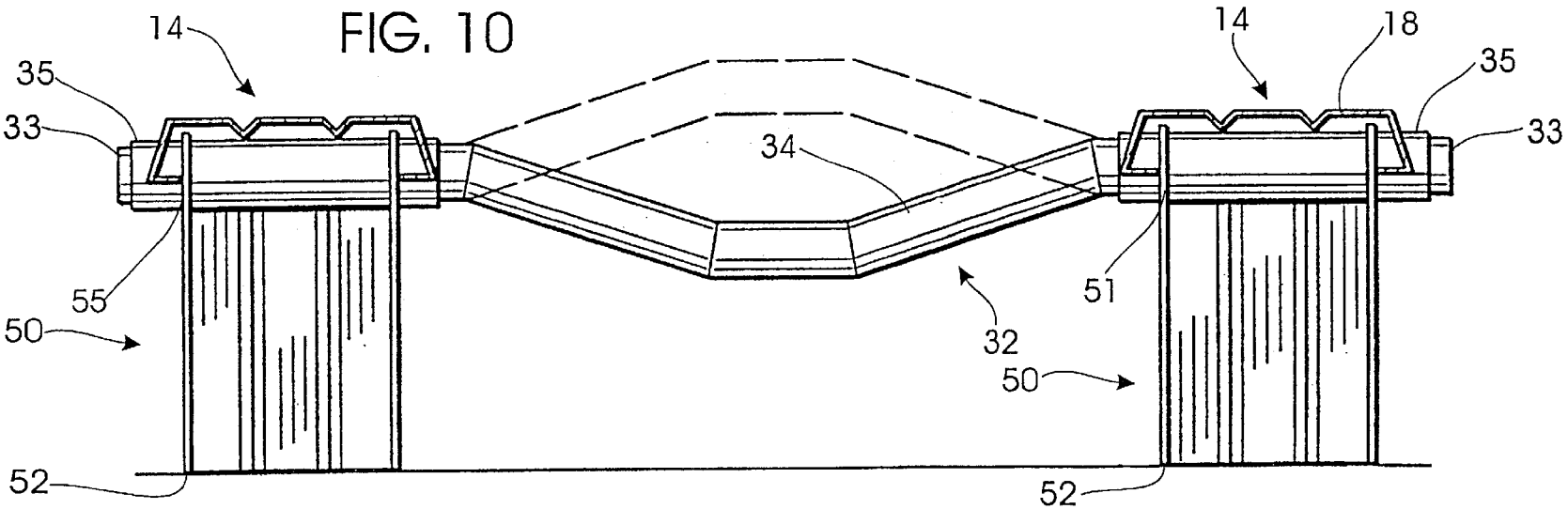
FIG. 10 is a perspective rear view of the present invention showing the lifting bar in an intermediate offset configuration.
Figure 12:
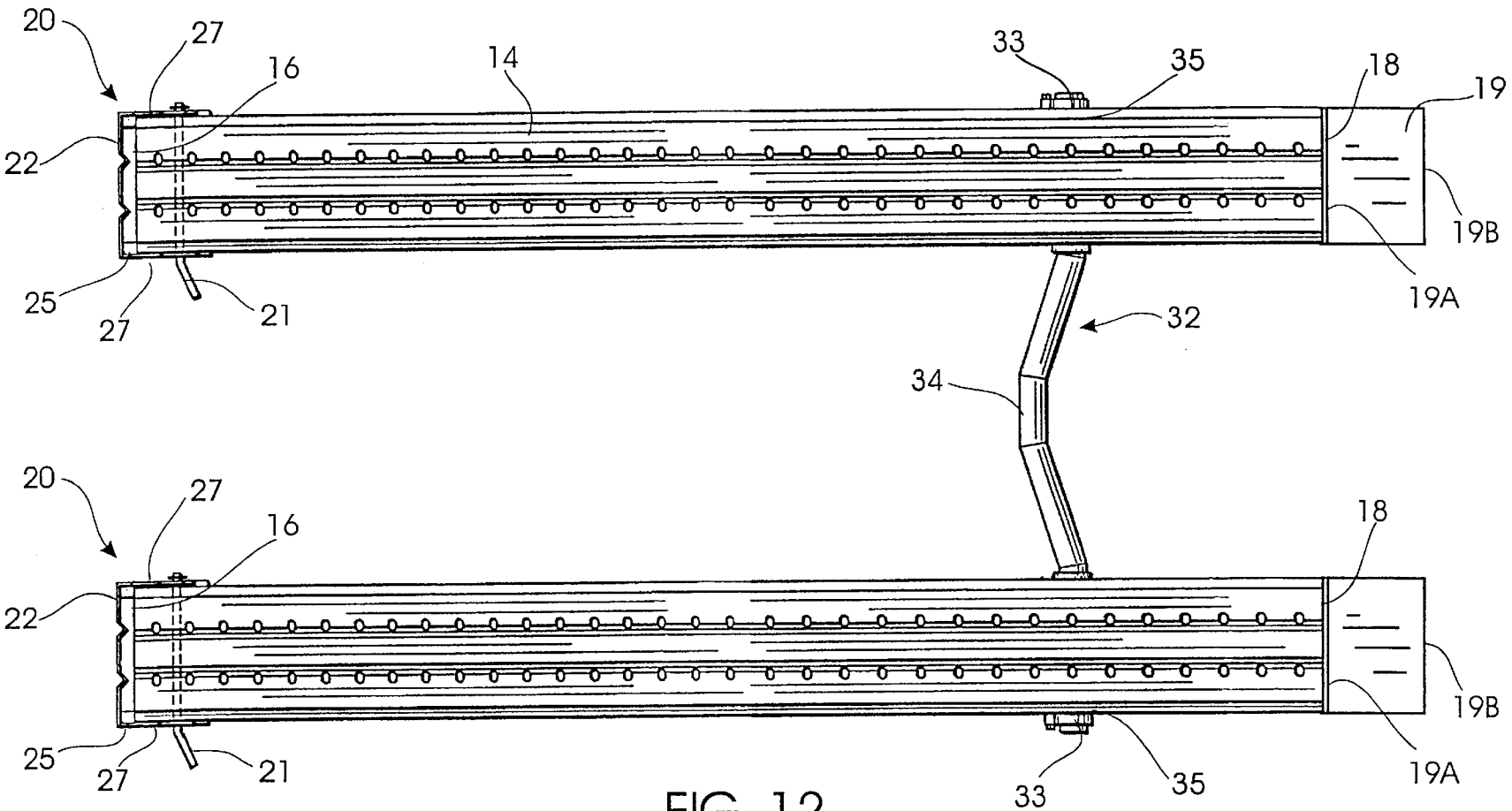
FIG. 12 is a top plan view of the present invention showing the lifting bar in an intermediate offset configuration.
Figure 14:
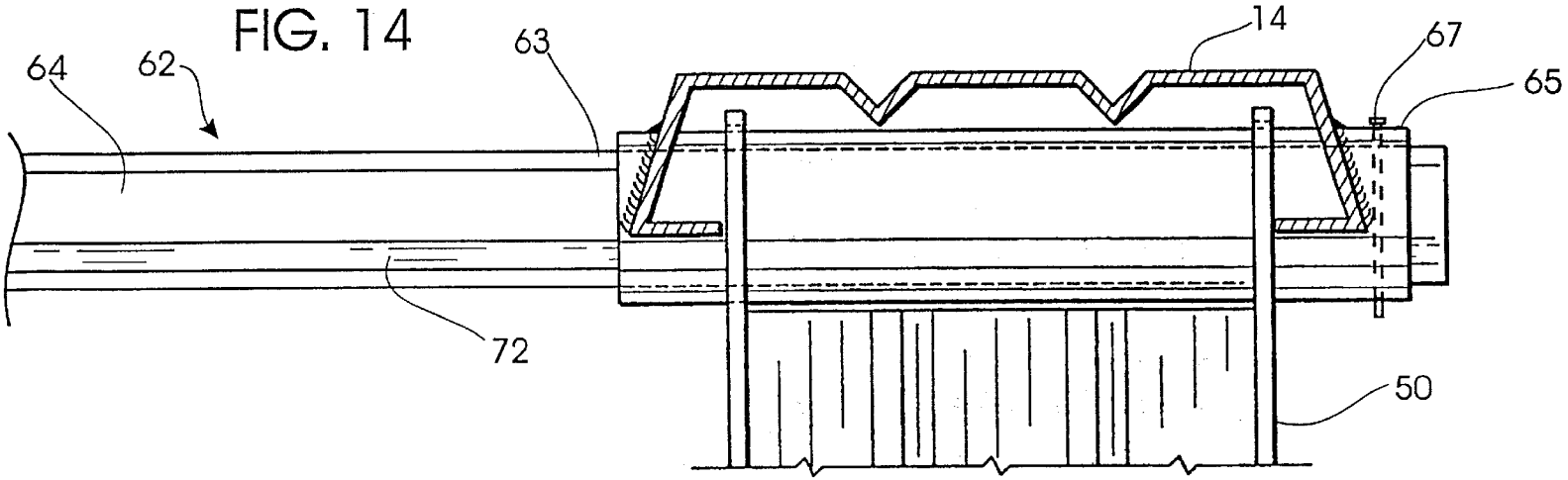
FIG. 14 is a detailed view of the rear housing assembly of FIG. 13.
Figure 13:
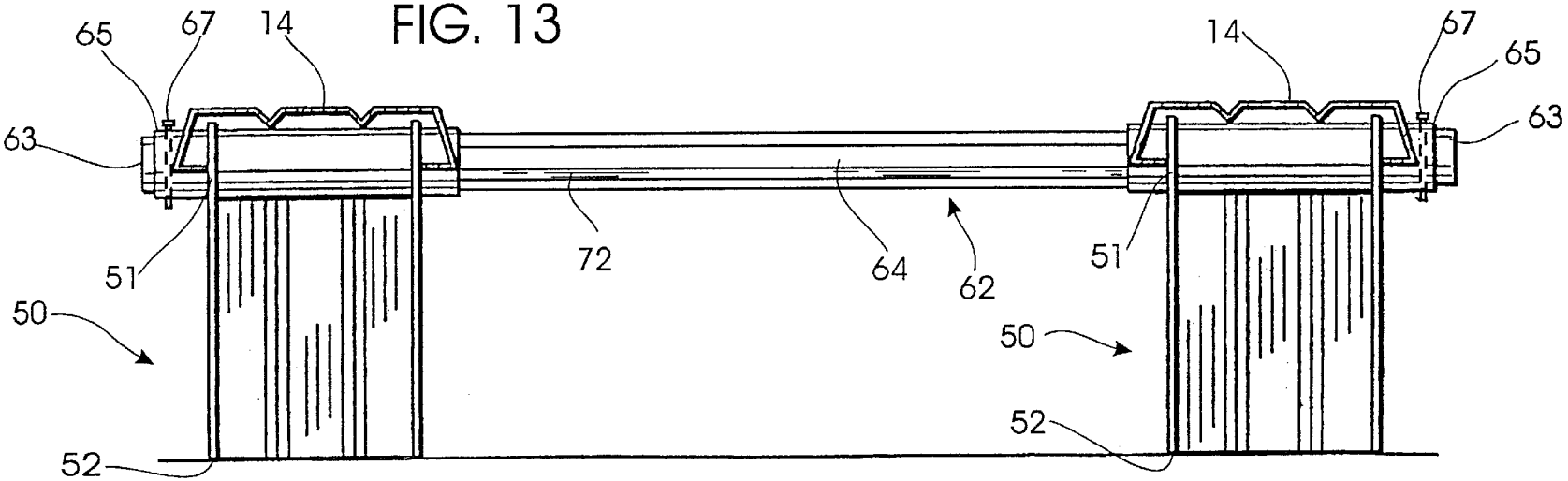
FIG. 13 is a perspective rear view of the present invention showing lifting bar utilizing a lifting rod configuration.
Figure 15:
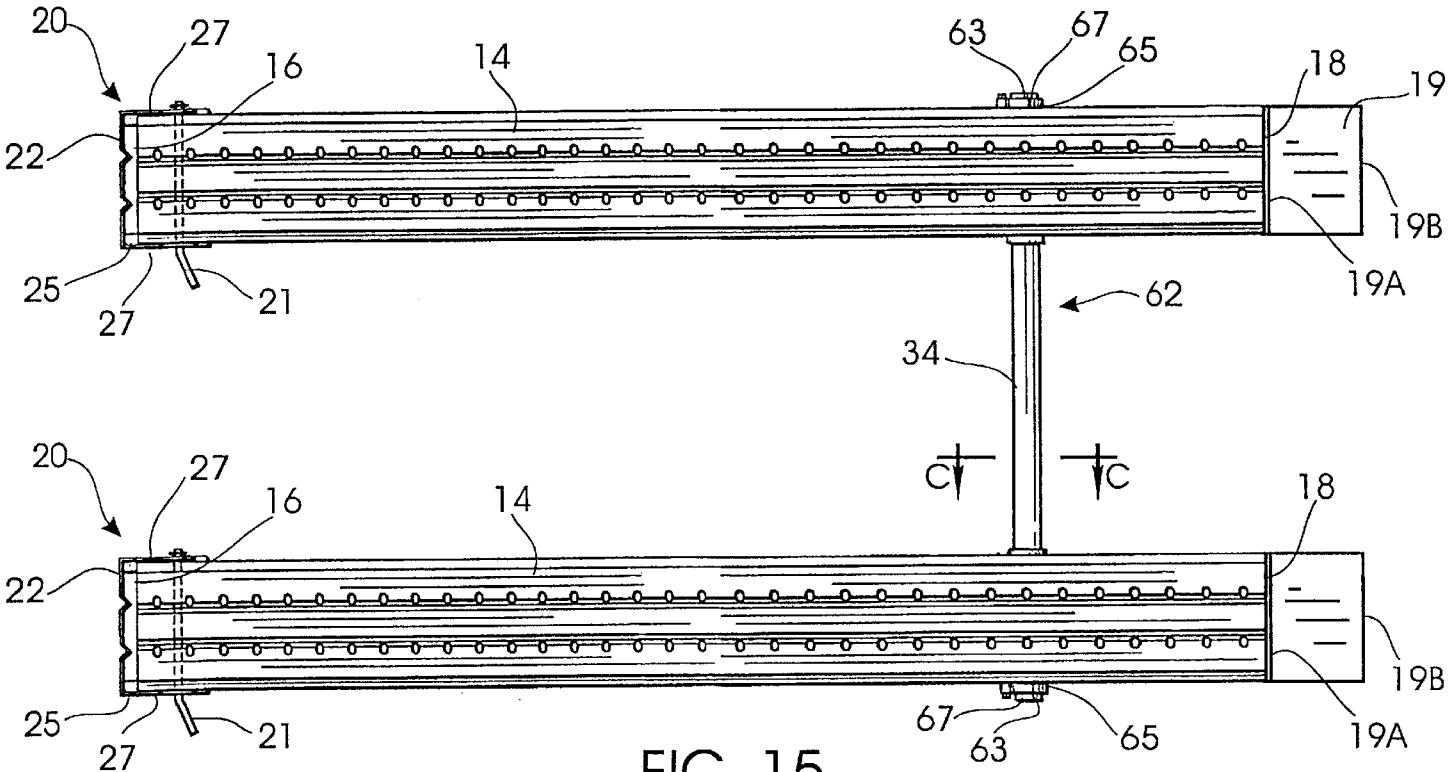
FIG. 15 is a top plan view of the present invention showing the lifting rod configuration in an offset configuration.
Figure 16:
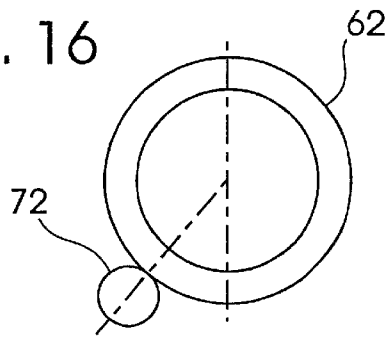
FIG. 16 is a cross-sectional view of the lifting bar of FIG. 15 along line 16—16.

With respect to the lifting bar, it accomplishes its purpose of lifting and lowering ramps 14 by providing various lifting means, such as floor jacks, forklift jacks, and other suitable lifting means with a structure which can transfer its lifting ability to the ramps 14 simultaneously, or near simultaneously. Two general embodiments of the lifting bar includes an intermediate offset configuration and a lifting rod configuration. As shown in FIGS. 10–12, the lifting bar embodiment utilizing the intermediate offset configuration comprises of ends 33, generally located on a central axis and an intermediate portion 34 which is generally offset from center axis. End portion 33 is pivotally received within tube 35. This allows lift bar 32 to be pivotally moveable as to allow intermediate middle portion 34 to be in contact with the ground as well as any generally upright position.

In an alternative embodiment, as shown in FIGS. 13–16, lifting bar 62 utilizing the lifting rod configuration comprises ends 63, generally located on a central axis. End portion 63 is pivotally received within tube 65. Attached to support lifting bar 62 is lift rod 72 which is generally located approximately 10–20° off of center. This allows lifting means 40 to engage and lift support lifting bar 62. Securing pin 67 secures support lifting bar 62 in a non-rotational position.

Whereas, the present invention has been described in relation to the drawings attached hereto, it should be understood that other and further modifications, apart from those shown or suggested herein, may be made within the spirit and scope of this invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A portable vehicle lift comprising:

a lift bar, having a first end and a second end with said first end and second end aligned generally along a center axis;

a pair of base units, with each said base unit in contact with the ground, a pair of ramps in parallel, wherein each ramp comprises a front end, a rear end, and means to pivotally receive said lift bar, wherein each front end is pivotally attached to a base unit allowing each ramp to be movable between a generally horizontal position and an angled position, wherein each said rear end is in contact with the ground while each said ramp is in an angled position, and a support leg pivotally attached to each said ramp.

2. The portable vehicle lift of claim 1 wherein each support leg further comprises:

a pivot end mounted to said rear end of each ramp, and a ground engaging end, whereby when said ramp is in a generally horizontal position, said ground engaging end engages the ground.

3. The portable vehicle lift of claim 1 wherein each ramp further comprises a plurality of detachable sections for portability and storage.

4. The portable vehicle lift of claim 1 wherein said lift bar extends between each said ramps intermediate length thereof.

5. The portable vehicle lift of claim 1 wherein said means to pivotally receive said lift bar is located proximate to said rear end.

6. The portable vehicle lift of claim 1 further comprising a pair of transition ends, each transition end having a first end and a second end with said first end secured to a said rear end of each said ramp with each said transition end tapered downward from said first end to said second end to allow vehicles a smooth transition from the ground onto said ramps.

7. The portable vehicle lift of claim 1 further comprising a lifting rod secured to said lift bar to assist a lifting means in moving each said ramp between a generally horizontal position and an angled position.

8. The portable vehicle lift of claim 1 further comprising a securing means to prevent said lift bar from rotating when said ramps are in motion between a generally horizontal position and in an angled position.

9. The portable vehicle lift of claim 1 wherein said lifting means is a forklift jack.

10. The portable vehicle lift of claim 1 wherein said lift bar is further defined as having a first end, a second end and an intermediate portion, with said first end and second end aligned generally along a center axis, with said intermediate portion generally offset from said center axis.

11. A portable vehicle lift comprising:

a plurality of lift bars, each having a first end and a second end with said first end and second end aligned generally along a center axis;

a plurality of ramps in parallel, wherein each ramp comprises a front end, a rear end, and means to pivotally receive said lift bars, wherein each ramp is movable between a generally raised position and an lowered position, wherein each said ramp is in contact with the ground while in a lowered position, and a support leg pivotally attached to each said ramp.

12. The portable vehicle lift of claim 11 wherein said lift bar is further defined as having a first end, a second end and an intermediate portion, with said first end and second end aligned generally along a center axis, with said intermediate portion generally offset from said center axis.

13. The portable vehicle lift of claim 11 wherein each support leg further comprises:

a pivot end mounted to said rear end of each ramp, and a ground engaging end, whereby when said ramp is in a generally horizontal position, said ground engaging end engages the ground.

14. The portable vehicle lift of claim 11 further comprising a pair of transition ends, each transition end having a first end and a second end with said first end secured to a said rear end of each said ramp with each said transition end tapered downward from said first end to said second end to allow vehicles a smooth transition from the ground onto said ramps.

15. The portable vehicle lift of claim 11 further comprising a lifting rod secured to said lift bar to assist a lifting means in moving each said ramp between a generally raised position and a lowered position.

16. The portable vehicle lift of claim 11 further comprising a securing means to prevent said lift bar from rotating when said ramps are in motion between a generally raised position and in a lowered position.

17. A method to lift a vehicle with a portable vehicle lift having a lift bar having a first end, a second end with said first end and second end aligned generally along a center axis, a pair of base units, and a pair of parallel ramps, each having a front end, a rear end and means to pivotally receive said lift bar, wherein each said front end is pivotally connected to a base unit allowing each said ramp to movable between a generally horizontal and angled position, said method comprising the steps of:

(a) positioning each rear end of each ramp in an angled position so that each rear end is in contact with the ground, (b) moving vehicle on to said ramps via the rear end of each said ramp, (c) positioning a lifting means between ground and said lift bar, and (d) raising lift bar, by activating said lifting means, which in turn raises said ramps.

18. The method to lift a vehicle of claim 17 wherein said lifting means is a forklift jack.

19. A method to lift a vehicle with a portable vehicle lift having a plurality of lift bars, and a plurality of parallel ramps, each having a front end, a rear end and means to pivotally receive said lift bars, wherein each said ramp to movable between a generally raised position and generally lowered position, said method comprising the steps of:

(a) positioning each ramp in a lowered position so that each ramp is in contact with the ground;

(b) moving vehicle on to said ramps;

(c) positioning a lifting means between ground and said lift bars, and (d) raising said lift bars, by activating said lifting means, which in turn raises said ramps into a raised position.

* * * * *